US008309874B2

(12) United States Patent
Hou et al.

(10) Patent No.: US 8,309,874 B2
(45) Date of Patent: Nov. 13, 2012

(54) GAS HEATER

(75) Inventors: Tao Hou, Palo Alto, CA (US); Son T. Nguyen, San Jose, CA (US); Kenric Choi, San Jose, CA (US); Anh N. Nguyen, Milpitas, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1216 days.

(21) Appl. No.: 12/122,616

(22) Filed: May 16, 2008

(65) Prior Publication Data

US 2009/0283252 A1 Nov. 19, 2009

(51) Int. Cl.
*H05B 1/00* (2006.01)

(52) U.S. Cl. ..... 219/50; 219/201; 219/494; 165/287; 165/181; 159/7; 159/13.2; 422/198

(58) Field of Classification Search ..... 431/11, 431/326, 328, 207, 208, 89; 422/202; 123/553, 123/557, 549, 546, 552, 543, 547; 392/484, 392/492, 493, 496; 165/135, 164, 287, 181; 137/101.19, 101.11, 487.5, 340, 341, 505.46, 137/487; 219/201, 494
See application file for complete search history.

(56) References Cited

U.S. PATENT DOCUMENTS

| | | | | |
|---|---|---|---|---|
| 2,401,797 | A | 6/1946 | Rasmussen | |
| RE23,795 | E * | 3/1954 | Cartinhour | 392/492 |
| 2,868,944 | A * | 1/1959 | Koch et al. | 392/492 |
| 3,833,791 | A | 9/1974 | Schladitz | |
| 4,308,915 | A | 1/1982 | Sanders et al. | |
| 4,367,717 | A * | 1/1983 | Ray | 123/557 |
| 4,795,618 | A | 1/1989 | Laumen | |
| 5,443,053 | A | 8/1995 | Johnson | |
| 5,520,211 | A | 5/1996 | Schonstein et al. | |
| 5,809,980 | A * | 9/1998 | Diduck | 123/549 |
| 6,345,611 | B1 | 2/2002 | Hartman et al. | |
| 6,431,857 | B1 * | 8/2002 | Charmes et al. | 431/328 |
| 7,207,191 | B2 | 4/2007 | Zhu et al. | |
| 2001/0030040 | A1 | 10/2001 | Xiao | |
| 2002/0108743 | A1 | 8/2002 | Wirtz | |
| 2003/0154700 | A1 | 8/2003 | Rothig | |
| 2004/0231187 | A1 * | 11/2004 | Moretto | 34/576 |
| 2005/0241632 | A1 * | 11/2005 | Alfoldi et al. | 126/116 R |
| 2006/0088386 | A1 * | 4/2006 | Ellis | 405/211.1 |
| 2007/0158451 | A1 * | 7/2007 | Mao et al. | 239/13 |
| 2008/0230184 | A1 * | 9/2008 | Eigenberger et al. | 159/7 |

FOREIGN PATENT DOCUMENTS

| | | | |
|---|---|---|---|
| DE | 102005023956 | A1 * | 11/2006 |
| GB | 292395 | | 6/1928 |

* cited by examiner

*Primary Examiner* — Tu B Hoang
*Assistant Examiner* — Thien S Tran
(74) *Attorney, Agent, or Firm* — Patterson & Sheridan, LLP

(57) ABSTRACT

A method and apparatus for heating or cooling a fluid. An inlet conduit coupled to a plurality of distribution nozzles in fluid communication with a channel at the periphery of the apparatus. An insert and a sleeve cooperatively define a thin gap, in fluid communication with the channel, through which the fluid flows. Thermal inserts near the thin gap generate heat flux into or out of the fluid, which exits through an outlet conduit.

2 Claims, 3 Drawing Sheets

GAS HEATER

BACKGROUND OF THE INVENTION

1. Field of the Invention

Embodiments of the invention relate generally to semiconductor processing, and more particularly to an apparatus for treating a substrate.

2. Description of the Related Art

Semiconductor manufacturing processes rely heavily on chemical reactions to build devices on substrates. These chemical reactions are often sustained in processing chambers in which vapor species are brought into contact with substrates to be processed. Chemical species are provided as vapors to control reaction rate, duration, and uniformity across the substrate, and are sometimes ionized to varying extents to promote reactions.

The vapor species may be produced from liquids or solids contained in vessels connected to the processing chambers by piping. The precursor species are generally heated to vaporize them. In some embodiments, the heat is applied directly to the precursor species, while in others a carrier gas is heated and contacted with the precursors to heat and vaporize them. In any event, heat must be applied, and the precursors must be maintained in the vapor state while traveling to the processing chamber.

In-line heaters of various designs have commonly been used to heat gases for semiconductor processing. Recently, as devices formed on semiconductor substrates have continued to become smaller, all facets of semiconductor manufacture are forced to reduce dimensions. Thus, there is a continuing need for process elements, such as heat exchangers, useable for the next generation of semiconductor manufacturing processes.

SUMMARY OF THE INVENTION

Embodiments of the invention provide a heat exchanger, comprising a first subassembly comprising an insert and a first plurality of heat exchange elements disposed within the insert; and a second subassembly comprising a sleeve and a second plurality of heat exchange elements disposed within the sleeve, wherein the insert is sealably engaged inside the sleeve and the insert and the sleeve cooperatively define a thin gap.

Embodiments of the invention also provide a thermal controller, comprising an inlet conduit coupled to a first portion of a body, the first portion having a plurality of nozzles and a first plurality of thermal elements disposed therein, the plurality of nozzles in fluid communication with the inlet conduit, a second portion of the body coupled to the first portion, and configured to mate sealably with the first portion, that together with the first portion cooperatively defines a distribution channel and a thin gap within the body, the second portion having a second plurality of thermal elements disposed therein, wherein the distribution channel and thin gap are in fluid communication with the plurality of nozzles; and an outlet conduit coupled to the second portion and in fluid communication with the thin gap.

Further embodiments of the invention provide a heat exchanger, comprising an inlet conduit coupled to the center of a surface of a first portion and in fluid communication with a passage inside the first portion; a plurality of nozzles in fluid communication with the passage and generally perpendicular thereto, each of the passages forming an opening in a surface of the first portion; a first plurality of thermal inserts disposed within the first portion, surrounding the passage inside the first portion and generally oriented parallel thereto, each insert spaced between two of the plurality of nozzles; a second portion configured to mate sealably with the first portion, that together with the first portion cooperatively defines a distribution channel and a thin gap, the distribution channel comprising a surface of the second portion and an annular recess formed in the first portion, wherein each of the plurality of nozzles is in fluid communication with the distribution channel and the thin gap; a second plurality of thermal inserts disposed within the second portion and aligned with the plurality of nozzles; a temperature sensor; an over-temperature controller; and an outlet conduit coupled to the center of a surface of the second portion and registering with the thin gap.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The invention generally provides an apparatus for thermal control of a fluid in a semiconductor manufacturing process. The fluid may be liquid or vapor.

Figure 1:
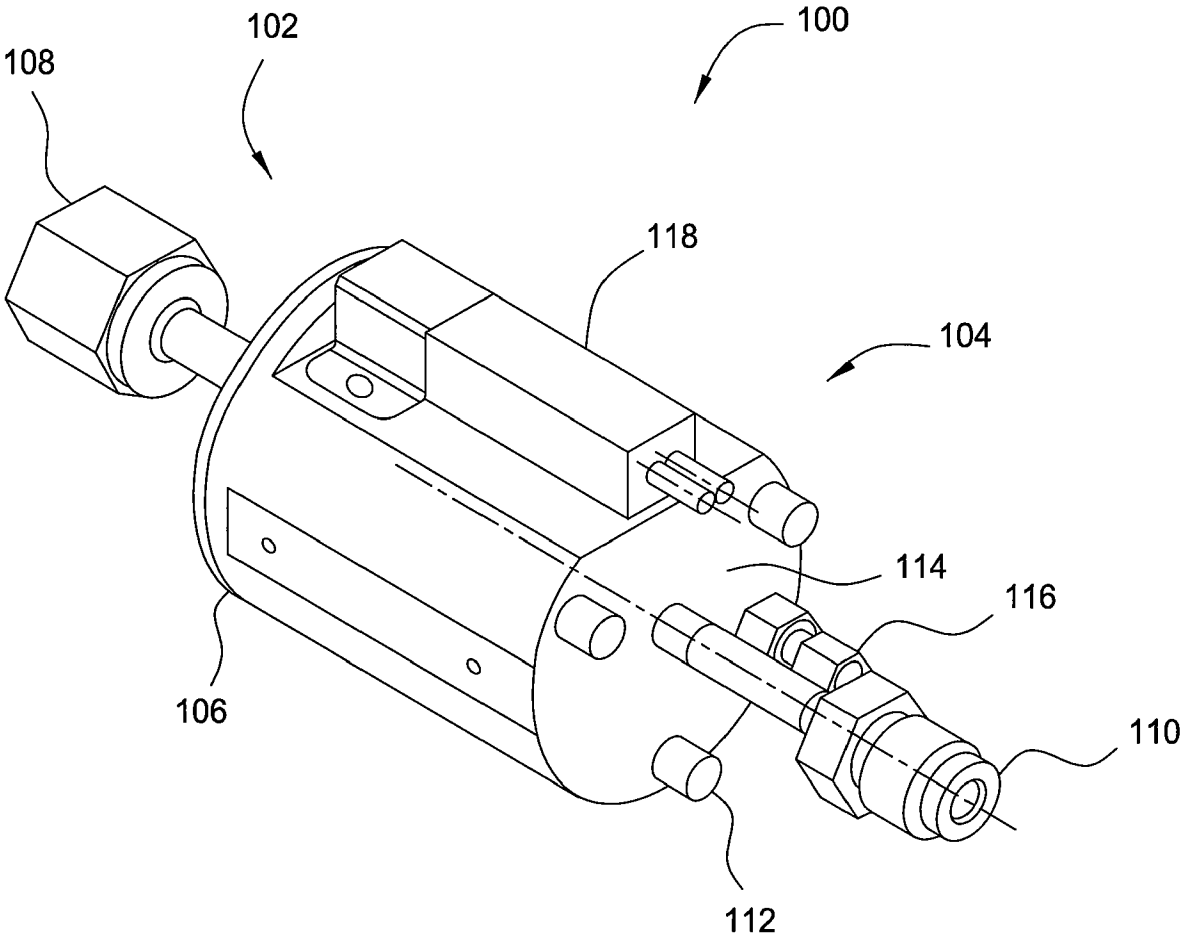
FIG. 1 is a perspective view of an apparatus according to one embodiment of the invention.

FIG. 1 is an isometric view of an apparatus 100 according to one embodiment of the invention. The apparatus 100 comprises a first portion 102 and a second portion 104 that fit together at joint 106. An inlet conduit 108 is coupled to a surface (not visible in FIG. 1) of the first portion 102, and an outlet conduit 110 is correspondingly coupled to a surface 114 of the second portion 104. Thermal elements 112 are disposed in the second portion 104, as is a temperature sensor 116. A controller 118 is also coupled to the second portion 104.

Figure 2:
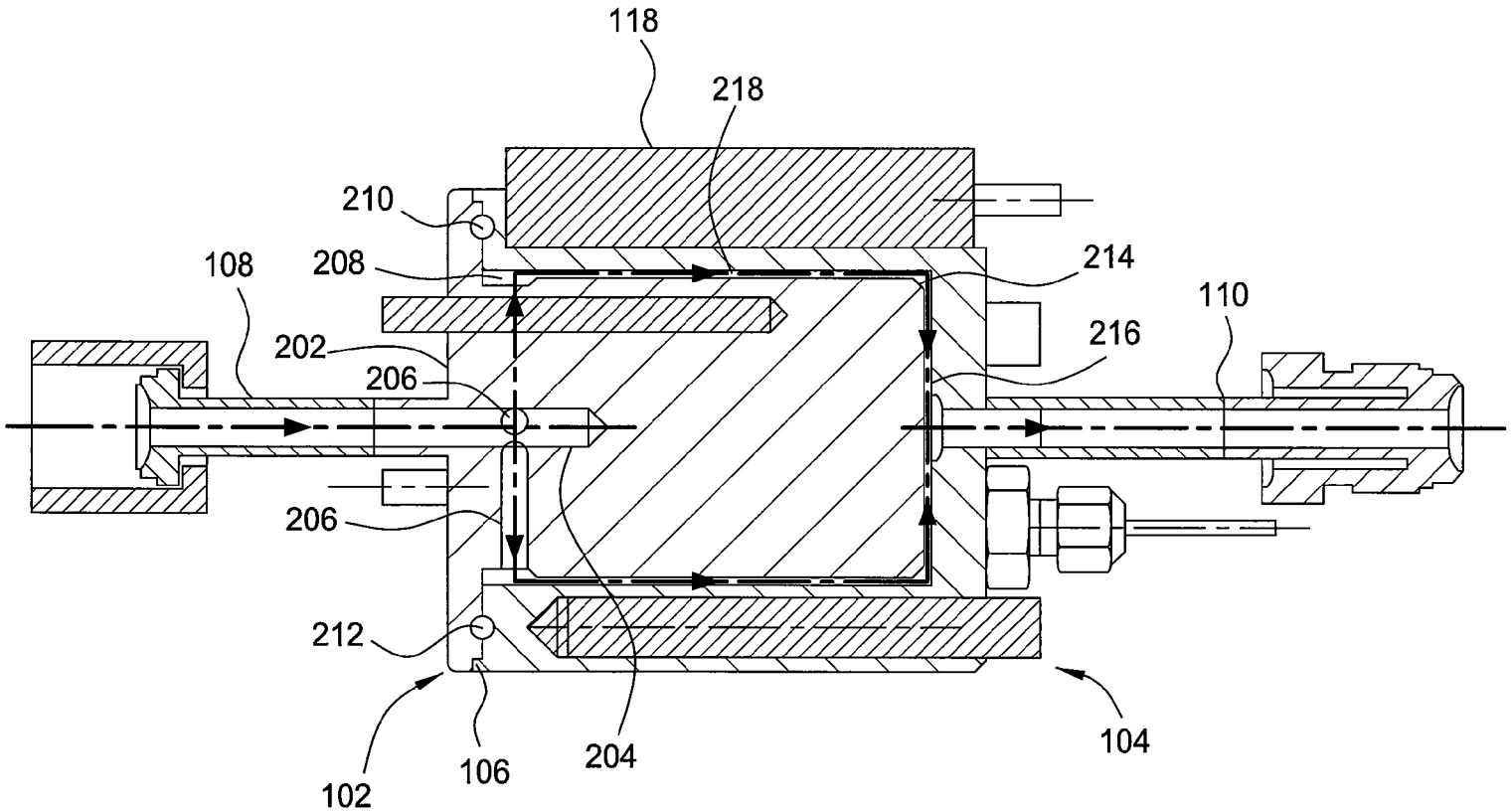
FIG. 2 is a cross-sectional view of the apparatus of FIG. 1.

FIG. 2 is a cross-sectional view of the apparatus 100 of FIG. 1. The inlet conduit 108 couples to the surface 202 of the first portion 102, and registers with a passage 204 formed in the first portion 102. The coupling of the inlet conduit 108 to the surface 202 of the first portion 102, and the passage 204, are shown substantially centered along an axis of the apparatus 100, but alternate embodiments may position these elements at any convenient location away from the central axis. In other embodiments, multiple inlet conduits may be spaced across the surface 202.

A plurality of nozzles 206 connects the passage 204 formed within the first portion 102 to a channel 208 around the periphery of the first portion. The nozzles 206 may be substantially perpendicular to the passage 204, or they may form an angle with the passage 204. The nozzles 206 place the channel 208 into fluid communication with the passage 204 and the inlet conduit 108. The passage 204 may extend beyond the point at which the nozzles 206 contact the passage 204 in some embodiments. In other embodiments, the passage 204 may end at the nozzle attachment point. The nozzles 206 may be formed with the same diameter as the passage 204 within the first portion 102. In some embodiments, the diameter of the nozzles 206 will be constant from the point at which they contact the passage 204 to the point at which they contact the channel 208. In other embodiments, the diameter of the nozzles 206 may change along their length. It is preferable that all nozzles 206 have the same diameter profile along their length to avoid flow imbalances within the apparatus. In some embodiments, a first diameter of each nozzle 206 at the channel 208 will be smaller than a second diameter at the passage 204. In other embodiments, the first diameter will be larger than the second diameter. The plurality of nozzles 206 may comprise any convenient number of nozzles. The embodiment illustrated in FIGS. 1 and 2 has three nozzles, as suggested by FIG. 2, but designs having more than three, or less than three, nozzles are conceivable.

In embodiments featuring multiple inlet conduits, as described above, the conduits may register with one or more common passages, such as the passage 204 of FIG. 2, or each inlet conduit may have a dedicated passage to the channel 208. For example, three inlet conduits may be spaced evenly across the surface 202 of the first portion 102, each registering with one of the three nozzles 206 of the FIG. 2 embodiment. Embodiments of this kind may also be constructed having more than three or less than three pathways.

The first portion 102 is configured to mate sealably with the second portion 104 at joint 106. A seal is formed at joint 106 by virtue of a sealing member 210 disposed in an opening 212 cooperatively defined by complimentary recesses formed in the sealing surfaces of the first portion 102 and the second portion 104. In some embodiments, the sealing member may comprise a compliant material able to form a seal under compression, such as any suitable variety of rubber. The first and second portions have thermal surfaces 214 and 216, respectively, which together define the channel 208 and a thin gap 218. The thin gap 218 is preferably less than about 0.1 inches in width, more preferably less than about 0.05 inches, such as about 0.025 inches. The thin gap 218 between the thermal surfaces 214 and 216 results in excellent heat exchange with a fluid flowing through the thin gap 218. In embodiments wherein the first portion 102 and the second portion 104 are generally cylindrical in shape, the thin gap 218 may be annular in shape. Fluid flow through the thin gap 218 may be laminar or turbulent, with similar thermal exchange results.

Figure 3:
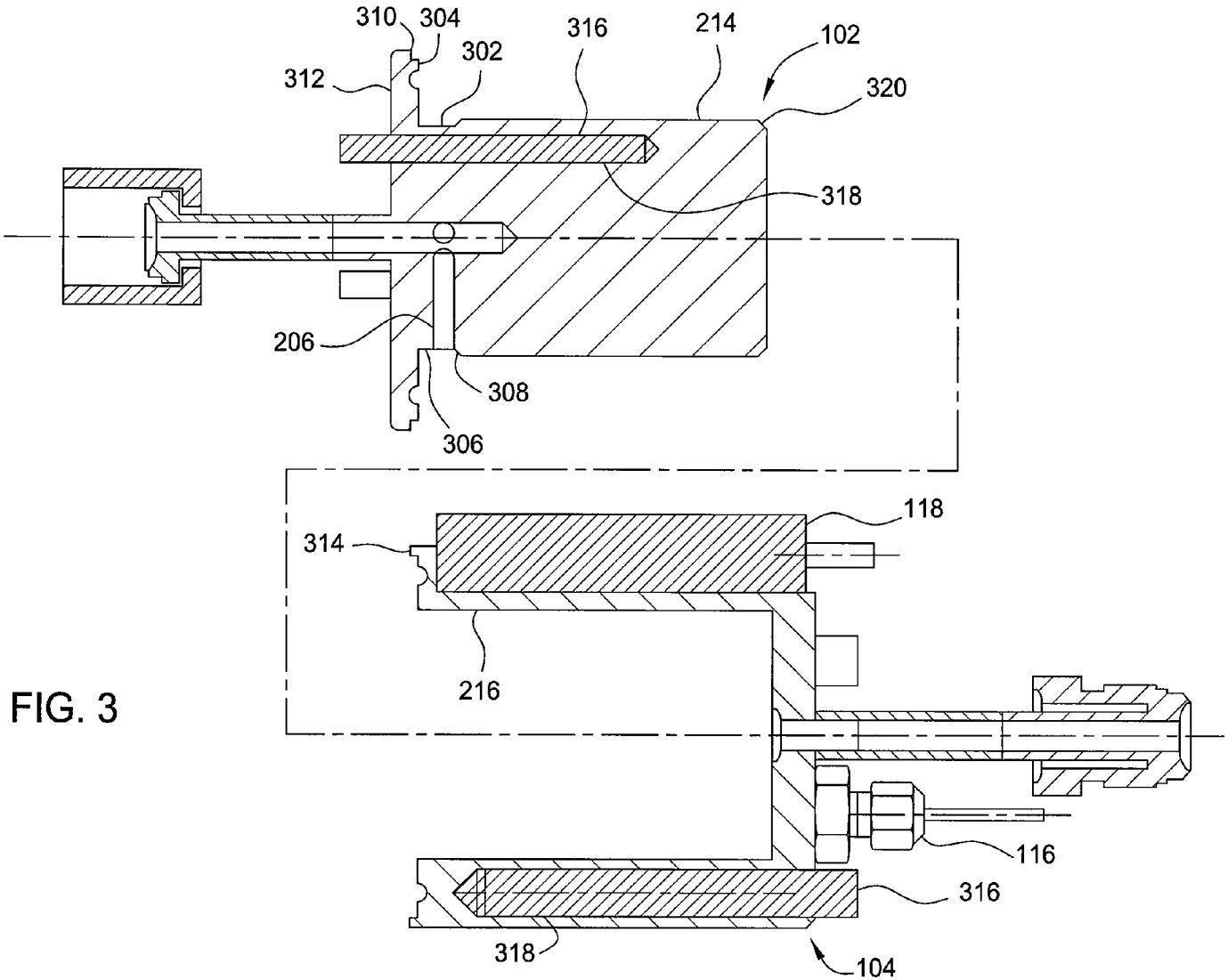
FIG. 3 is an expanded cross-sectional view of the apparatus of FIG. 1.

FIG. 3 is an expanded view of the apparatus of FIGS. 1 and 2, showing the first portion 102 of the apparatus 100 and the second portion 104 spaced apart for illustration purposes. In some embodiments, the first portion 102 has a recess 302 formed proximate the sealing surface 304 of the first portion 102. The recess 302, together with the thermal surface 216 of the second portion 104, defines the channel 208 shown in FIG. 2. The channel 208 is in fluid communication with the thin gap 218 and the plurality of nozzles 206 formed in the first portion 102. Fluid flowing through the plurality of nozzles 206 from the inlet conduit 108 flows around the channel 208, distributing evenly before flowing into the thin gap 218. The recess 302 has a floor 306 adjacent to the sealing surface 304 and a wall 308. In this embodiment the wall 308 has a sloped profile, but in alternate embodiments the wall 308 may be substantially perpendicular to the floor 306, or it may have a curved profile with a convex or concave shape. The shape of the wall 308 influences how fluid flows from the channel 208 into the thin gap 218.

The first portion 102 has a notch 310 at an edge of a flange 312, the flange 312 comprising the sealing surface 304. In some embodiments, the notch 310 may be an alignment notch. The notch 310 mates with a rim 314 on the second portion 104. The notch 310 and rim 314 are shown in this embodiment with a generally rectangular profile, but both may be formed with any convenient profile, so long as they are complimentary. In some embodiments, the notch 310 and rim 314 facilitate alignment of the first portion 102 with the second portion 104 to ensure consistent dimension of the thin gap 218.

Each of the plurality of nozzles 206 provides a pathway connecting the passage 204 in the first portion 102 with the channel 208. In some embodiments, the nozzles 206 may be distribution nozzles. The nozzles 206 in the embodiment of FIG. 3 have a constant diameter that is less than the width of the recess 302, but in alternate embodiments the nozzles may have different dimensions. For example, the nozzles may have a varying diameter that decreases from the passage 204 to the channel 208, or the diameter may increase from the passage 204 to the channel 208. In another embodiment, the nozzles 206 may have tapered openings leading into the channel 208. In most embodiments, the plurality of nozzles 206 will be spaced evenly about the passage 204. In an embodiment with three nozzles 206, each nozzle will preferably form an angle of 120° with the other two nozzles. In an embodiment with four nozzles, the preferred angle will be 90°.

As shown in FIG. 3, the first portion 102 further comprises one or more thermal elements 316 for generating an energy flux through the apparatus. The thermal elements are generally housed in one or more receptacles 318 formed in the first portion 102. In some embodiments, the thermal elements 316 may be heaters, while in other embodiments they may be coolers. In some embodiments, the thermal elements 316 may be resistive heating elements, and in other embodiments the thermal elements 316 may be electrical heating elements. In other embodiments, the thermal elements may be configured to provide a hot or cold fluid to drive heat flux. In some embodiments, the thermal elements 316 may be thermal inserts. A plurality of thermal elements 316 is generally provided in most embodiments to facilitate uniform and rapid heat flux, but embodiments comprising one thermal element 316 in the first portion 102 are conceivable. In embodiments featuring a plurality of thermal elements 316, the thermal elements 316 will generally be spaced equally throughout the first portion 102. For example, in the embodiment shown in FIGS. 1 through 3, the first portion 102 comprises three thermal elements 316 housed in three receptacles 318. The thermal elements of the FIG. 3 embodiment are spaced evenly through the first portion 102 in a pattern similar to the spacing of the nozzles 206. In the FIG. 3 embodiment, each thermal element 316 is located opposite a nozzle 206. The thermal elements 316 are located near the thermal surface 214 of the first portion 102. The distance between a surface of the thermal elements 316 closest to the thermal surface 214 is selected to provide structural integrity, vigorous thermal exchange, and substantial thermal spreading along the thermal surface 214. More distance between the thermal elements 316 and the thermal surface 214 promotes structural integrity and spreading of heat at the expense of heat exchange, with more heat held inside the first portion 102. Less distance localizes and speeds heat exchange, but risks failure of the thermal surface 214.

The thermal elements 316 of the embodiment of FIGS. 1-3 are rod-like, cylindrical in shape with rectangular profile, but they may be any convenient shape so long as they make intimate contact with the bulk of the first portion 102 when inserted into receptacles 318. Shape profiles such as square, rectangular, triangular, polygonal, oval, frustroconical, or starburst may be useful in some embodiments. The thermal elements 316 of FIGS. 1-3 also exhibit conical ends, but may also be flat, beveled, rounded, hemispherical, and the like. Moreover, the first portion 102, as shown in FIG. 3, exhibits a generally rectangular profile, and is generally cylindrical in shape, with a beveled edge portion 320. The beveled edge portion 320 facilitates fluid flow through the thin gap 218 to achieve the desired throughput. The bulk of the first portion 102, may, however, have any convenient shape. Instead of being cylindrical, it may be rectangular, triangular, polygonal, frustruconical, or starburst-like in shape. The edge portion 320 may likewise be rounded or hemispherical in profile. A rounded or curved profile may further promote smooth fluid flow through the thin gap 218. The second portion 104 will preferably have a complimentary shape to the first portion 102 to preserve the dimension of the thin gap 218.

Referring again to FIG. 3, in some embodiments the second portion 104 is a sleeve into which the first portion 102 is inserted. In some embodiments the second portion 102 also has thermal elements 316. The thermal elements 316 of the second portion 102 are generally shaped to follow the contours of the thermal surface 216. In the embodiment of FIG. 3, the thermal elements 316 of the second portion 104 are also rod-like and cylindrical in shape, with a rectangular profile and conical end. These thermal elements may likewise be any convenient shape, and may be resistive or electrical heaters, or fluid heat exchange elements, such as those described above. Depending on the needs of particular embodiments, the thermal elements 112 of the second portion 104 may be larger or smaller than those of the first portion 102. In most embodiments, the thermal elements 112 of the second portion 104 will be aligned with, and equidistant from, the thermal elements 112 of the first portion 102. If the thermal elements 112 of the first portion 102 are equidistant from the nozzles 206, the thermal elements 112 of the second portion 104 may be aligned with the nozzles 206, as shown in FIG. 2.

In some embodiments, a temperature sensor 116 may be provided, as described above in reference to FIG. 1. The temperature sensor 116 may be a thermocouple, resistance thermometer, diode bandgap sensor, thermistor, electron tunneling sensor, or any other convenient device for sensing temperature. In most embodiments, the temperature sensor 116 will be disposed to register the temperature of the fluid passing through the thin gap 218. In some embodiments, the temperature sensor may be disposed in a receptacle (not shown) formed in the second portion 104. A receptacle similar to the receptacles 318 may be used to house the temperature sensor 116, if the temperature sensor 116 has a rod-like shape. Other types of temperature sensors 116 may be embedded in the second portion 104 near the thermal surface 216. A temperature sensor 116 embedded in the thermal surface 216 will preferably be located near the junction between the thin gap 218 and the outlet conduit 110 to measure the full temperature change of the fluid in the device.

Some embodiments of the invention will provide a controller 118. In the embodiment of FIGS. 1-3, the controller 118 is attached to the second portion 104 of the apparatus 100. The controller 118 may be electrical for controlling electrical thermal elements, or it may control a valve by electrical or pneumatic means for thermal elements incorporating a heat exchange fluid or medium. In the embodiment of FIGS. 1-3, the controller 118 is an over-temperature controller that reduces or shuts off power to the thermal elements 316 if the temperature of the fluid in the thin gap 218 reaches a specified temperature above the target temperature. A controller such as the controller 118 may also be used to increase or reduce thermal flux of the thermal elements 316 in response to a measured temperature compared with a target temperature. The controller 118 may be an analog controller, such as a switch activated by an electrical signal from the temperature sensor, or a digital controller under the direction of a computer program. In some embodiments, the controller may also be remotely located, depending on specific needs.

Embodiments of the invention may be configured to heat a gas such as nitrogen flowing at 10 standard liters per minute from room temperature of about 25° C. to about 200° C. using 3 electrical heater rods, each 0.125 inches in diameter and 2 inches long, and 3 electrical heater rods, each 0.125 inches in diameter and 1.5 inches long. Application of about 40 Watts of electrical power to each heater rod, and flowing the gas through a thin gap pathway about 1 inch long at the flow rate specified above achieves an exit temperature of 200° C. For such a heater, the first portion or insert, the second portion or sleeve, and the heater rods may all be made of a metal such as stainless steel or aluminum.

A longer pathway allows heating to a higher temperature, or at higher throughput. The heater above extended to a 2 inch thin gap pathway will heat 20 SLM to 200° C., or 10 SLM to 250° C. Multiple such heaters may be used in series to boost the temperature of a gas by stages. At higher temperatures, materials capable of retaining their shape and thermal conductivity as temperatures rise are preferred. In some embodiments, alloys such as Inconel may be useful. At higher temperatures, insulation may be applied around the apparatus and secured with an enclosure to prevent unnecessary heat loss. Finally, increased roughness of the thermal surfaces 214 and 216 may aid in heat transfer by increasing contact area for heat exchange.

In operation, the device described above embodies a method of changing the thermal state of a fluid. The fluid is introduced to a device configured to force the fluid into intimate contact with one or more thermal agents. The thermal agents generate heat flux with respect to the fluid, changing its thermal state and, in some embodiments, its temperature.

In a preferred embodiment, the fluid may be forced to follow a sheet-like path through a thin gap. Forcing the fluid through a thin gap increases the surface area of thermal contact for the fluid volume, speeding up thermal exchange. In some embodiments, the gap may be engineered to assume a convenient shape, such as that of an annulus or rectangular annulus, and the pathway may incorporate folding or reversals.

The fluid may be exposed to thermal agents to generate heat flux into or out of the fluid. The thermal agents may be point or line agents, or may be distributed sources such as plane agents. The thermal agents may be heat sources or sinks, and may have uniform thermal capacity or varying thermal capacity. For example, in one embodiment multiple line sources of heat may be placed in close proximity to a sheet-like stream of fluid flowing through a thin gap to heat the fluid. The line sources may be oriented along the path of flow or perpendicular to the path of flow, and may be uniformly or non-uniformly spaced. For example, line sources may be concentrated near an upstream portion of the thin gap path. The thermal agents may be electrical in nature or may incorporate a hot or cold medium for generating heat flux.

The thermal state of the fluid flowing through the thin gap may be controlled by providing a sensor and a controller. The sensor may be a thermocouple or any other suitable device. The controller may be an analog controller, such as a switch configured to interrupt the thermal flux generated by the thermal agents when signaled by the sensor, or it may be a digital controller under the direction of a computer program.

While the foregoing is directed to embodiments of the invention, other and further embodiments of the invention may be devised without departing from the basic scope thereof, and the scope thereof is determined by the claims that follow.

What is claimed is:

1. A heat exchanger, comprising:

a body having a first portion and a second portion configured to mate sealably with the first portion, wherein the first portion and the second portion cooperatively defines a distribution channel and a thin gap, the distribution channel comprising a surface of the second portion and an annular recess formed in the first portion;

an inlet conduit coupled to the center of a surface of the first portion and in fluid communication with a passage inside the first portion;

a plurality of nozzles formed in the first portion in fluid communication with the passage and generally perpendicular thereto, each of the nozzles in fluid communication with the distribution channel and the thin gap and forming an opening in a surface of the first portion;

a first plurality of thermal inserts disposed within the first portion, surrounding the passage inside the first portion and generally oriented parallel thereto, each insert spaced between two of the plurality of nozzles;

a second plurality of thermal inserts disposed within the second portion and aligned with the plurality of nozzles;

a temperature sensor;

an over-temperature controller; and an outlet conduit coupled to the center of a surface of the second portion and in fluid communication with the thin gap.

2. The heat exchanger of claim 1, wherein the first portion and the second portion are metal.

* * * * *